US008123054B2

(12) United States Patent
Smith et al.

(10) Patent No.: US 8,123,054 B2
(45) Date of Patent: Feb. 28, 2012

(54) DISPENSING CAPS FOR BEVERAGE CONTAINERS

(75) Inventors: Matthew Eric Smith, Ballaugh (IM); Karl Mondszein, Mansfield (GB)

(73) Assignee: Carbonite Corporation, Panama (PA)

( * ) Notice: Subject to any disclaimer, the term of this patent is extended or adjusted under 35 U.S.C. 154(b) by 454 days.

(21) Appl. No.: 12/514,063

(22) PCT Filed: Nov. 13, 2007

(86) PCT No.: PCT/GB2007/004340

§ 371 (c)(1),
(2), (4) Date: Jun. 24, 2009

(87) PCT Pub. No.: WO2008/059236

PCT Pub. Date: May 22, 2008

(65) Prior Publication Data

US 2010/0044338 A1 Feb. 25, 2010

(30) Foreign Application Priority Data

Nov. 17, 2006 (GB) ..... 0622974.4

(51) Int. Cl.
*B65D 1/04* (2006.01)

(52) U.S. Cl. ..... 215/6; 215/DIG. 8; 206/219

(58) Field of Classification Search ..... 220/255, 220/523; 215/6, 316, DIG. 8; 206/219, 220, 206/221, 222, 568; 222/145.1, 499, 563, 222/507, 129, 89
See application file for complete search history.

(56) References Cited

U.S. PATENT DOCUMENTS 4,821,875 A * 4/1989 Groves et al. ..... 206/219
7,886,899 B2 * 2/2011 Frutin ..... 206/221

FOREIGN PATENT DOCUMENTS

| | | |
|---|---|---|
| DE | 8518074 | 2/1986 |
| EP | 1600395 | 11/2005 |
| WO | 2005/092732 | 10/2005 |
| WO | 2006/062418 | 6/2006 |

* cited by examiner

OTHER PUBLICATIONS

PCT International Search Report for PCT/GB2007/004340 dated Feb. 12, 2008.

*Primary Examiner* — Anthony Stashick
*Assistant Examiner* — Jeffrey Allen
(74) *Attorney, Agent, or Firm* — Harry K. Ahn; Abelman Frayne & Schwab

(57) ABSTRACT

A drinking cap includes a first tubular portion (10) for connection to the mouth of a beverage container and an elongate actuating member (26) situated at least partly within the first tubular portion (10) and connected to it by a resilient, annular, integral web (12), in which one or more flow openings (28) are formed. The actuating member (26) is longitudinally movable in the axial direction between an open position of the flow openings (28) and a closed position thereof. The cap also includes an insert (6) and a piston (4) which together define a reservoir (56). The insert (6) includes a cylindrical wall (34) and a portion (40) which is movable under the action of pressure within the reservoir and in which a discharge aperture (44) is formed. A flow tube (52) is connected to the piston (4) around an aperture (50) and extends through the discharge aperture (44) in the insert (6) and forms a sliding seal with the edge (46) of the discharge aperture. The actuating member (26) is arranged to engage the piston (4) when it is moved from the closed position to the open position and thus to move the piston (4) towards the insert (6), whereby the increased pressure created in the reservoir (56) causes the movable portion (4) of the insert (6) to move away from the piston (4) until the flow tube (52) moves out of the discharge aperture (44) in the insert (6).

10 Claims, 1 Drawing Sheet

DISPENSING CAPS FOR BEVERAGE CONTAINERS

CROSS REFERENCE TO RELATED APPLICATIONS

Figure 1:
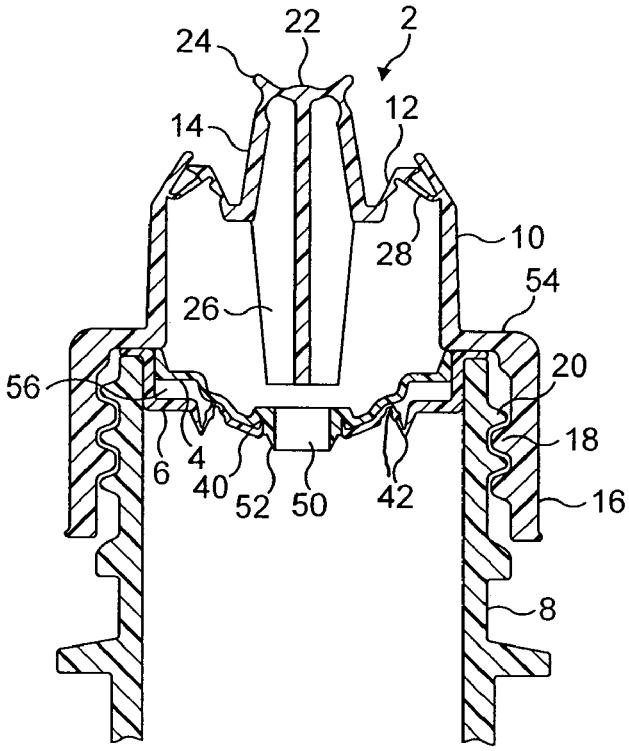

This application is a national phase of PCT application No. PCT/GB2007/004340, filed Nov. 13, 2007, which claims priority to GB patent application No. 0622974.4, filed Nov. 17, 2006, all of which are incorporated herein by reference.

The present invention relates to dispensing caps for beverage bottles or other containers and is particularly concerned with drinking caps for containers for carbonated beverages. Such dispensing caps typically include two moulded plastic components which are connected together and are relatively movable between a first position, in which the bottle, to which the cap is connected, is sealed and a second position, in which the interior of the bottle communicates with the exterior through one or more openings through which a liquid in the bottle may flow. Such caps thus provide a resealing facility and, in the case of a drinking cap, the ability to drink from the bottle without removing the cap. However, the two separate components must be moulded separately and then connected together. This is both time-consuming and expensive.

One-piece dispensing caps are known and DE-G-8518074.2 discloses such a cap of the type including a first tubular portion with a first radius for connection to the mouth of a container and a second circular section tubular portion with a second radius smaller than the first radius, the first tubular portion being connected to the second tubular portion by a resilient, annular, integral web, in which one or more flow openings are formed, the width of the web being equal to or greater than the difference between the first and second radii, one end of the second tubular portion being closed, one of the web and the internal surface of the first tubular portion being connected to a projecting annular first sealing flange, the first and second tubular portions being coaxial and relatively movable in the axial direction between an open position, in which the flow openings are unobstructed, and a closed position, in which the sealing flange is in sealing engagement with the other of the web and the internal surface of the first tubular portion, whereby the flow openings are prevented from communicating with the atmosphere by the sealing engagement of the first sealing flange with the other of the web and the internal surface of the first tubular portion. However, the cap disclosed in this document is for dispensing powdery solid materials and not liquids and would be inherently unsuitable for use on a liquid container because it is incapable of forming a reliable liquid seal, particularly if the liquid is carbonated. Thus when the cap is in the closed configuration, the sealing flange and the web are in surface contact. Such surface contact is incapable of providing a reliable seal because the contact force is inherently very low and exerted over a substantial area, whereby the contact pressure is extremely small. As a matter of practice, it is impossible to form the two engaging surfaces completely smooth and complementary and the resulting inevitable gaps will mean that any liquid in the container will be subject to leakage.

More specifically, the invention relates to drinking caps for multiple component, particularly two-component, beverages. Many beverages comprise a liquid, typically water, which may be carbonated, mixed with a flavouring in liquid or syrup form. The flavouring is frequently unstable in storage when mixed with the water and this necessitates the addition of stabilisers which are not only expensive but are increasingly thought to be undesirable on health grounds. Even when stabilisers are present, the flavouring tends to be degraded over time, e.g. photochemically, and this frequently necessitates the addition of a greater amount of expensive flavouring than would be necessary if the beverage were consumed immediately. The flavouring generally has a high sugar content and it is found that this sugar content results in progressive clogging of the filling nozzles when filling bottles with a mixture of water and flavouring.

It would therefore be desirable to be able to store the flavouring separately from the other liquid in the bottle and only to mix it into the liquid very shortly before the beverage is consumed. It is therefore the object of the invention to provide a drinking cap for a beverage container which enables this to be achieved and is simple to manufacture and use.

According to the present invention, a drinking cap of the type including a first tubular portion for connection to the mouth of a beverage container and an elongate actuating member situated at least partially within the first tubular portion, the first tubular portion being connected to the actuating member by a resilient, annular, integral web, in which one or more flow openings are formed, one of the web and internal surface of the first tubular portion being connected to a projecting annular first sealing flange, the actuating member being longitudinally movable in the axial direction between an open position, in which the flow openings are unobstructed, and a closed position, in which the sealing flange is in sealing engagement with the other of the web and the internal surface of the first tubular portion, whereby, in use, the flow openings are prevented from communicating with the atmosphere and the container is sealed, is characterised in that the cap further includes an insert and a piston which together define a reservoir, the insert including a cylindrical wall and a portion which is movable under the action of pressure within the reservoir and in which a discharge aperture is formed, the piston including a peripheral edge in sliding contact with the cylindrical wall and having an aperture, a flow tube being connected to the piston around the aperture and extending through the discharge aperture in the insert and forming a sliding seal with the edge of the discharge aperture, and that the actuating member is arranged to engage the piston when it is moved from the closed position to the open position and thus to move the piston towards the insert whereby the increased pressure created in the reservoir causes the movable portion of the insert to move away from the piston until the flow tube moves out of the discharge aperture in the insert.

Thus the drinking cap in accordance with the present invention fulfils two quite different functions. It constitutes a resealable closure for a beverage container, which may simply be opened by moving the actuating member relative to the first tubular portion, whereafter the user may drink from the container without removing the cap from the container, and then closed again by moving the actuating member back to its original position. In addition, however, one component of a two-component beverage may be stored within the reservoir defined by the piston and the insert. The component within the reservoir is stored separately from the liquid within the body of the container but when the dispensing cap is opened for the first time, as the actuating member is moved from the closed position to the open position, it comes into contact with the piston and forces it towards the insert. This results in pressurisation of the contents of the reservoir and this increased pressure acts on the movable portion of the insert which then moves under the action of this pressure away from the piston. The discharge aperture in the insert thus moves relative to the flow tube, which extends through it and forms a seal with its edge, until the flow tube moves out of the discharge aperture. The interior of the reservoir then communicates with the interior of the container via the discharge aperture in the insert and the component within the reservoir then flows under gravity and also the action of the pressure within the reservoir into the container. The component within the reservoir thus becomes mixed with the liquid in the container. If the container is now inverted, liquid will flow through the flow tube to the space beneath the web connecting the actuating member to the first tubular portion and from there through the apertures formed in the web to the atmosphere or, more usually, directly into the mouth of the user.

The ability to maintain the two components of a two-component beverage separate until shortly before consumption is associated with a number of advantages. Thus the liquid in the body of the container is typically water or carbonated water and no stabilisers therefore need to be added because the flavouring is retained separately in the small sealed compartment constituted by the reservoir. The flavouring in the reservoir is therefore not subject to degradation by light or the like and it is found that a smaller amount of flavouring is thus sufficient, thereby producing a significant financial economy. Since the container is filled with liquid with no flavouring in it, the risk of clogging of the filling nozzles is substantially reduced or eliminated.

The dispensing cap in accordance with the invention includes a first tubular portion, preferably of circular section, and an actuating member and this actuating member is preferably constituted by a second tubular portion, which is also preferably of circular section. The two tubular portions are connected by a resilient annular web, whose width, that is to say length in the generally radial direction, will be greater than the difference between the radii of the two tubular portions in order to provide the necessary relative movability of the two tubular portions. The tubular portion of greater radius is adapted for connection to the mouth of a bottle or the like at one end and the other end of the other tubular portion is preferably closed. The resilient web has at least one and preferably a number of spaced flow openings formed in it. In the preferred embodiment, the web carries a sealing flange connected to its upper or external surface at a point intermediate its ends, as seen in axial sectional view. The second tubular portion is thus movable in the axial direction with respect to the first tubular portion between an open position, in which the flow openings are unobstructed, and a closed position, in which the sealing flange is in engagement with the internal surface of the first tubular portion, thereby sealing the flow openings from the atmosphere. This means that the container to which the drinking cap is connected is also sealed and thus that no liquid may leave it.

When the two tubular portions are in the open position and a force is applied to the second or smaller tubular portion to move it into the closed position, the initial movement of the second tubular portion will necessarily result in compression and/or deformation of the web due to the fact that its length is necessarily greater than the distance between the two tubular portions. This compression and/or deformation will result in the web exerting a restoring force on the tubular portion of lesser diameter urging it back towards the open position. However, as the closing force continues to be exerted, the tubular portion of smaller diameter will move progressively in the axial direction towards the closed position. As it passes through the position in which the web extends substantially in the radial direction, the force exerted by the web on the tubular portion of smaller diameter will act on it to urge it towards the closed position. The actuating member or tubular portion of smaller diameter is thus effectively bistable and if no external force is applied to it, it will automatically move to either the open or the closed position. The sealing flange is positioned and dimensioned such that it is moved into sealing contact with the opposing surface on the interior of the tubular portion of large diameter before the web has reached the fully relaxed position. This means that, in the closed position, the sealing flange is biased into contact with the opposing surface and forms a continuous, substantially line seal with it. The fact that the sealing flange is on the external surface of the web means that if there should be a superatmospheric pressure within the container, e.g. as the result of liberation of carbon dioxide from the carbonated beverage, its pressure will act to increase the pressure with which the sealing flange contacts the first tubular portion and will thus increase the integrity of the seal.

Although the drinking cap in accordance with the invention may be constructed to permit the simultaneous addition of two or even more different ingredients into the liquid within the body of the container by dividing the reservoir into two or more separate compartments, each of which is provided with a respective discharge aperture, it is intended that the drinking cap is to be used primarily with containers for two-component beverages and thus that the reservoir will contain only a single component. In this event, it is preferred that the flow tube and the discharge aperture in the insert are aligned with the length of the actuating member, that is to say are situated on the longitudinal axis of the first tubular portion, and that the actuating member is shaped to engage the piston at one or more positions outside the edge of the tube but not substantially to impede the flow of liquid through the flow tube. Thus it will be appreciated that when liquid is dispensed from the container, it must all flow through the flow tube and it is therefore important that this flow is not significantly impeded. The portion of the actuating member which engages the piston may have a variety of shapes and may, for instance, be of simple plate shape which will then extend diametrically across the flow tube but it is preferred that it is of cruciform shape and thus engages the piston at four equiangularly spaced regions around the flow tube.

The opening of the discharge aperture in the insert to permit the discharge of the ingredient within it when the cap is moved into the open position is achieved by the fact that a portion of the insert is movable relative to the remainder of the insert by the action of a pressure acting within the reservoir. In a simple embodiment, the movable portion of the insert may be constituted by a resilient, e.g. elastomeric membrane which will distend under the action of pressure and thus move away from the piston. In an alternative embodiment, the movable portion of the insert comprises a cup-shaped piston member with a side wall in sliding contact with a fixed cylindrical wall carried by the remainder of the insert and a base in which the aperture is formed. However, both of these constructions necessitate the insert being made of two separate components and in the preferred embodiment the movable portion of the insert is integral with the cylindrical wall and connected to it by two or more annular fold lines of opposite sense.

In the preferred embodiment, the internal surface of the first tubular portion carries a resilient annular second sealing flange, which projects at an acute angle to the axis of the first tubular portion and is positioned so that it is sealingly engaged by the first sealing flange, when the cap is in the closed position. The provision of this second sealing flange inclined to the axis of the first tubular portion means that the sealing engagement of the first sealing flange with the second sealing flange is substantially at right-angles, whereby the integrity of the seal is maximised.

The invention embraces also a beverage container including a drinking cap of the type referred to above, the container including a mouth to which the first tubular portion is connected, the insert being located substantially within the mouth of the container.

The insert may be permanently connected to the first tubular portion but this is not essential and all three components, that is to say the first tubular portion connected to the actuating member, the insert and the piston may be separate components. In one embodiment, there is a peripheral flange projecting outwardly from the upper end of the cylindrical wall of the insert and the first tubular portion of the drinking cap is connected to a depending annular skirt extending around the mouth of the container by an annular web extending transverse to the axis of the first tubular portion, the peripheral flange on the insert being sandwiched between the upper surface of the mouth of the container and the annular web. The insert is thus retained in position by engagement of its peripheral flange on the rim of the container extending around the container opening and is sealed both to the upper surface of the rim and the under surface of the annular web by virtue of the pressure exerted on it by the web.

Figure 2:
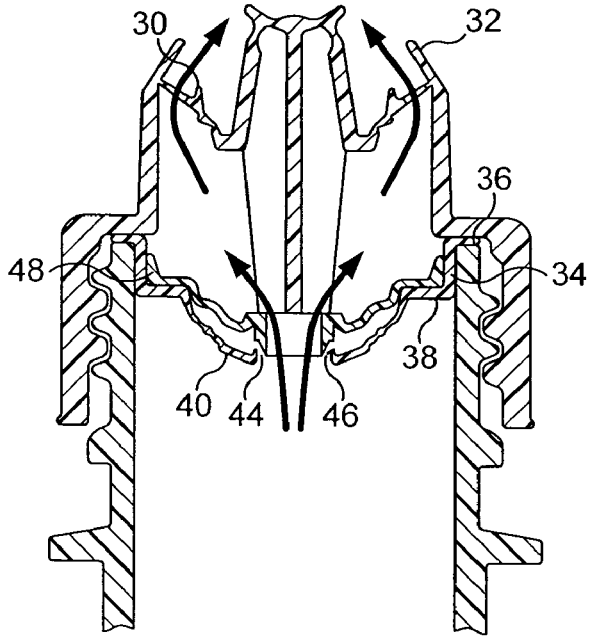

Further features and details of the invention will be apparent from the following description of one specific embodiment, which is given by way of example only with reference to the accompanying diagrammatic drawings, in which:

FIG. 1 is a diagrammatic axial sectional view of a drinking cap for a carbonated beverage container in the closed or sealed position; and FIG. 2 is a view similar to FIG. 1 showing the drinking cap in the open or unsealed position.

The drinking cap shown in the drawings essentially comprises three separate components, namely a closure cap 2, a piston 4 and an insert 6. The drinking cap is shown attached to a bottle, of which only the neck 8 is shown.

The closure cap 2 is a one-piece injection moulded component of polymeric material, such as polypropylene, and comprises a first circular section tubular portion 10 of relatively large diameter, which is integrally connected at a position adjacent its upper end by a resilient flexible web 12 to one end of a second circular section tubular portion 14, which is of progressively increasing diameter in the downward direction.

The larger tubular portion 10 is adapted to be connected to the neck 8 of a bottle. For this purpose, its diameter may be substantially the same as that of the neck of the bottle or, as in this case, it may be integrally connected by means of a horizontal annular flange 54 to a circular section connector portion 16 of yet greater diameter, that is to say with an internal diameter substantially equal to the external diameter of the neck of the bottle. The connector portion 16, which is in the form of a depending cylindrical skirt or wall, may be connected to the bottle in any convenient manner but in the present case it is provided with internal screw threads 18 for cooperation with corresponding screw threads 20 on the exterior of the neck of the bottle. Alternatively, the cap may be snap-fitted onto the bottle with a snap-fit connection of the type disclosed in WO 2005/092732. The upper end of the smaller diameter tubular portion 14 is closed by an integral lid 22, the diameter of which is slightly greater than that of the upper end of the tubular portion 14, whereby its radially outer edge constitutes a projecting flange or lip 24, which may be grasped by the user. Integral with the interior of the smaller tubular portion 14 is a cruciform structure 26 comprising two plates extending perpendicular to one another. The cruciform structure 26 extends substantially below the lower end of the tubular portion 14 and its function will be described below.

A plurality of holes 28 is formed in the resilient web 12. The width of the resilient web 12, that is to say its length between the two tubular portions, is greater than the difference between the radii of the two tubular portions. Integral with the upper or external surface of the web 12, at a point intermediate its ends, when seen in axial section, is a first annular sealing flange 30, which extends substantially in the axial direction, when the cap is in the open position illustrated in FIG. 2. Integral with the internal surface at the upper end of the larger tubular portion 10 is a second resilient sealing flange 32, which extends both upwardly and inwardly towards the axis of the cap, whereby it subtends an acute angle to the axial direction of the cap.

When the cap is in the open position shown in FIG. 2, the tubular portion or actuating member 14 is located substantially within the tubular portion 10. The web 12 extends downwardly from the tubular portion 10 and also inwardly in the axial direction and the flow openings 28 communicate with the interior of the cap, whereby liquid can flow out through the openings 28. A user can readily drink a beverage from the bottle by placing his lips around the outer surface of the tubular portion 10, which will act in the manner of a drinking spout. If an upward force is exerted on the smaller tubular portion 14, it begins to move upwardly. This results in compression and distortion of the web 12, which thus exerts a restoring force on the tubular portion 14 urging it back towards the fully open position. As the force continues to be exerted on the smaller tubular portion, it moves upwardly until the web 12 extends approximately horizontally, that is to say in the radial direction. As the tubular portion 14 moves through and beyond this "dead centre" position, the force exerted by the web 12 on the tubular portion 14 acts in the upward direction. The tubular portion 14 continues to move upwardly and this is accompanied by continuing rotation of the web 12. This movement continues until the free edge of the sealing flange 30 engages the surface of the resilient sealing flange 32. This occurs before the web 12 is fully relaxed, whereby when the upward force on the tubular portion 14 is removed, the force exerted by the web continues to urge the two sealing flanges into contact and the free edge of the flange 30 makes a sealed line contact with the surface of the sealing flange 32. This contact line is situated above the flow openings 28, which means that these flow openings are sealed from the atmosphere. The interior of the bottle is thus sealed and no liquid can flow out through the openings 28. If the beverage is carbonated, as soon as the cap is sealed an internal pressure will build up within the headspace of the bottle. This pressure will act on the underside of the web 12 and will increase the contact pressure between the flanges 30 and 32. This will further enhance the integrity of the seal. If it is desired to reopen the bottle, a downward force is again exerted on the tubular portion 14 and the process described above is reversed until the cap is again in the open position illustrated in FIG. 2.

The drinking cap also includes a piston 4 and an insert 6. The insert 6 comprises a vertically extending cylindrical wall 34, integral with whose upper end is a radially outwardly extending flange 36 and integral with whose lower end is a radially inwardly extending flange 38. Integrally connected to the inner edge of the flange 38 is a movable portion, which comprises a plate 40 connected to the flange 38 by a number, in this case two, of annular, preferably circular, integral hinges or folds 42. Formed in the centre of the plate 40 is a discharge aperture 44, the margin of which carries an upstanding small, resilient sealing lip 46.

The piston 4 comprises a dished plate of circular shape, integral with whose outer edge is a shallow upstanding wall 48. Formed in the centre of the dished plate is an aperture 50, integral with the margin of which is a depending circular flange or flow tube 52.

In use, the flange 36 of the insert is supported on the rim of the neck 8 of the bottle, whereby the remainder of the insert extends down into the neck of the bottle. The piston 4 is positioned so that its cylindrical wall 48 is in sliding contact with the cylindrical wall 34 of the insert, which acts as a cylinder for the piston. The flow tube 52 is accommodated within the discharge aperture 44 in the insert and forms a sliding seal with the resilient lip 46. The closure cap is connected to the neck of the bottle by means of the cooperating screw threads 18, 20 and sandwiches the flange 36 between the upper surface of the rim of the bottle and the horizontal flange 54 connecting the tubular portion 10 to the larger tubular portion 16.

The piston 4 and insert 6 together define, as shown in FIG. 1, a reservoir 56 which will accommodate one component of a two-component beverage, e.g. a flavouring in syrup form. As may be seen in FIG. 1, when the cap is in the closed configuration, the cruciform structure 26, whose width is somewhat greater than the internal diameter of the flow tube 50, is situated directly above but slightly spaced from the upper surface of the piston 4. However, when the upper tubular portion or actuator 14 is moved from the sealed position shown in FIG. 1 to the open position shown in FIG. 2, it comes into contact with the upper surface of the piston and thus presses the piston downwardly. This results in pressurisation of the contents of the reservoir 56 and this increased pressure acts on the movable portion 40 of the insert 6. This force results in relative rotation of the annular webs on each side of each fold line 42, which in turn results in downward movement of the movable portion 40. This downward movement results in movement of the discharge aperture 44 relative to the flow tube 52 until the flow tube 52 moves out of the discharge aperture. The reservoir 56 then communicates with the interior of the bottle and its contents are discharged through the discharge aperture 44 under the action of both gravity and the pressure prevailing within the reservoir. The flavouring material within the reservoir is thus mixed with the liquid, e.g. carbonated water, in the body of the bottle.

If the bottle is now inverted, the two-component mixed beverage will flow through the aperture 50 defined by the flow tube 52 into the space defined between the piston 4 and the web 12. This flow is scarcely impeded by the actuating member 14 since its lower end is of cruciform shape and thus constitutes only a small flow resistance. The liquid then flows outwardly through the openings 28, as shown by the arrows in FIG. 2, into a drinking vessel or the mouth of the user.

It will be appreciated the numerous modifications may be effected to the specific embodiment described above. For instance, in order to prevent premature or inadvertent discharge of the contents of the reservoir caused by e.g. shocks applied to the container during transport or storage, it may be desirable to provide the insert and piston with one or more small cooperating projections and recesses. The cooperation of the projections and recesses will lock the piston in position against the action of shock loads but the piston will nevertheless be movable by engagement of it by the actuating member, e.g. due to the resilience of the material of which the insert and piston are made. In the illustrated embodiment, the flange 32 is situated at the top of the first tubular portion 10 and the second tubular portion extends slightly above the first tubular portion even when in the open position. It is, however, of course possible for the first tubular portion 10 to be extended upwardly beyond the point of connection with the flange 32 to a position higher than the top of the second tubular portion, when in the open position. This modification will facilitate the user drinking directly from the bottle.

The invention claimed is:

1. A drinking cap including a first tubular portion for connection to the mouth of a beverage container and an elongate actuating member situated at least partially within the first tubular portion, the first tubular portion being connected to the actuating member by a resilient, annular, integral web, in which one or more flow openings are formed, one of the web and the internal surface of the first tubular portion, being connected to a projecting annular first sealing flange, the actuating member being longitudinally movable in the axial direction between an open position, in which the flow openings are unobstructed, and a closed position, in which the sealing flange is in sealing engagement with the other of the web and the internal surface of the first tubular portion, whereby, in use, the flow openings are prevented from communicating with the atmosphere and the container is sealed, characterised in that the cap further includes an insert and a piston which together define a reservoir, the insert including a cylindrical wall and a portion which is movable under the action of pressure within the reservoir and in which a discharge aperture is formed, the piston including a peripheral edge in sliding contact with the cylindrical wall and having an aperture, a flow tube being connected to the piston around the aperture and extending through the discharge aperture in the insert and forming a sliding seal with the edge of the discharge aperture, and that the actuating member is arranged to engage the piston when it is moved from the closed position to the open position and thus to move the piston towards the insert, whereby the increased pressure created in the reservoir causes the movable portion of the insert to move away from the piston until the flow tube moves out of the discharge aperture in the insert.

2. A drinking cap as claimed in claim 1 in which the flow tube and the discharge aperture in the insert are aligned with the length of the actuating member and the actuating member is shaped to engage the piston at one or more positions outside the edge of the tube but not substantially to impede the flow of liquid through the flow tube.

3. A drinking cap as claimed in claim 2 in which the portion of the actuating member closest to the piston is of cruciform shape.

4. A drinking cap as claimed in claim 1 in which the movable portion of the insert is integral with the cylindrical wall and connected to it by two or more annular fold lines of opposite sense.

5. A drinking cap as claimed in claim 1 in which the movable portion of the insert comprises a cup-shaped piston member with a side wall in sliding contact with a fixed cylindrical wall and a base in which the discharge aperture is formed.

6. A drinking cap as claimed in claim 1 in which the first sealing flange is integrally connected to the external surface of the web at a point intermediate its ends, as seen in axial sectional view, or to the internal surface of the first tubular portion whereby, when the cap is in the closed position, the free edge of the first sealing flange forms a substantially line seal with the internal surface of the first tubular potion or the external surface of the web.

7. A drinking cap as claimed in claim 1 in which the internal surface of the first tubular portion carries a resilient annular second sealing flange, which projects at an acute angle to the axis of the first tubular portion and is positioned so that it is sealingly engaged by the first sealing flange, when the cap is in the closed position.

8. A drinking cap as claimed in claim 1 in which the actuating member is constituted by a second tubular portion, the end of which remote from the insert is closed, the closed end carrying a radially projecting annular projection for engagement by the user to move the second tubular portion relative to the first tubular portion into the closed position.

9. A beverage container including a drinking cap as claimed in claim 1, the container including a mouth to which the first tubular portion is connected, the insert being located substantially within the mouth of the container.

10. A container as claimed in claim 9 in which projecting outwardly from the upper end of the cylindrical wall of the insert is a peripheral flange and the first tubular portion of the drinking cap is connected to a depending annular skirt extending around the mouth of the container by an annular web extending transverse to the axis of the first tubular portion, the peripheral flange on the insert being sandwiched between the upper surface of the mouth of the container and the annular web.

* * * * *